US006105767A

United States Patent [19]

Vasudeva

[11] Patent Number: 6,105,767

[45] **Date of Patent: *Aug. 22, 2000**

[54] TOOL CASE WITH BUTTERFLY DOOR

[75] Inventor: Kailash C. Vasudeva, Waterloo, Canada

[73] Assignee: Maxtech, Inc., Roseville, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/907,498

[22] Filed: Aug. 8, 1997

Related U.S. Application Data

[60] Provisional application No. 60/043,299, Apr. 11, 1997.

[51] Int. Cl.[7] ..... B65D 85/28

[52] U.S. Cl. ..... 206/372; 206/349; 206/373; 220/523; 220/528

[58] Field of Search ..... 206/349, 372, 206/373, 377, 379, 234; 220/221, 523, 528, 326, 324, 327; 150/118; 190/112, 119, 120, 121

[56] References Cited

U.S. PATENT DOCUMENTS

| | | | |
|---|---|---|---|
| 1,610,146 | 12/1926 | Panzer | 190/109 |
| 1,661,728 | 3/1928 | Rue | 220/523 |
| 1,827,929 | 10/1931 | Bigelow | 220/523 |
| 3,061,136 | 10/1962 | Sterngart | 220/20 |
| 3,937,352 | 2/1976 | Kalous | 220/327 |
| 4,974,740 | 12/1990 | Niles et al. | 220/324 |
| 5,103,994 | 4/1992 | Doxey et al. | 220/324 |
| 5,114,007 | 5/1992 | Chen | 206/373 |
| 5,125,697 | 6/1992 | Kahl et al. | 220/324 |
| 5,307,511 | 4/1994 | Takahashi | 220/324 |
| 5,368,164 | 11/1994 | Bennett et al. | 206/373 |
| 5,429,235 | 7/1995 | Chen | 206/373 |
| 5,520,400 | 5/1996 | Hung | 280/47.26 |
| 5,526,929 | 6/1996 | Wei | 206/378 |
| 5,570,784 | 11/1996 | Sidabras et al. | 206/379 |
| 5,676,254 | 10/1997 | Cheng et al. | 206/373 |
| 5,758,769 | 6/1998 | Vasudeva | 206/372 |
| 5,803,254 | 9/1998 | Vasudeva | 206/373 |
| 5,887,715 | 3/1999 | Vasudeva | 206/373 |

*Primary Examiner*—Irene Cuda
*Assistant Examiner*—Trinh Nguyen
*Attorney, Agent, or Firm*—R. Craig Armstrong

[57] ABSTRACT

An opening is defined within the bottom surface of the box portion of the tool case. A plastic panel recessed on the top and bottom faces to accommodate tools and components therefor is secured within the box portion. The top face of the panel is accessed in a conventional manner via a lid pivotably connected to the box portion, and the bottom face of the panel is accessed via a "butterfly" door pivotably connected to the bottom surface of the box portion. The butterfly door and the lid are secured to the box portion by a common securing means adapted to release one of either the butterfly door or the lid without releasing the other. The butterfly door is configured to pivot from a closed position where the butterfly door is flush with the bottom surface of the box portion, to an open position where the butterfly door is rotated away from the bottom surface of the box portion to provide access to the items stored within the bottom section of the tool case.

5 Claims, 14 Drawing Sheets

TOOL CASE WITH BUTTERFLY DOOR

This application claims benefit of provisional application Ser. No. 60/043,299 filed Apr. 11, 1997.

BACKGROUND OF THE INVENTION

Field of the Invention

This invention relates to a tool case, particularly of the type used to display a tool set at the point of sale, and to subsequently store the tool set. Such tool cases are commonly referred to as "gift cases".

Cases of the general type are well known, and typically include a base in the form of an open-topped box, and a lid hinged or otherwise mated with the box portion, with a clip or other means to secure the lid in the closed position. The case typically also contains a panel with a number of recesses to accommodate various tools and components, such as a screwdriver and various bits therefor, for example.

However, this conventional configuration does not efficiently use the available space in the case because a large volume of unused space is left between the panel and the bottom of the box portion of the case.

SUMMARY OF THE INVENTION

In view of the above, it is an object of the invention to provide an improved tool case with a storage space which is accessed from the underside of the tool case via what the inventor refers to as a "butterfly door" assembly.

In the invention, a preferably rectangular opening is defined within the bottom surface of the box portion of the tool case. A plastic panel recessed on both sides to accommodate tools and components therefor is secured within the box portion. The top face of the panel is accessed in a conventional manner via a lid pivotably connected to the box portion, and the bottom face of the panel is accessed via a "butterfly" door also pivotably connected to the box portion. The butterfly door and the lid are secured to the box portion by a common securing means adapted to release one of either the butterfly door or the lid without releasing the other. The butterfly door is configured to pivot from a closed position where the butterfly door is flush with the bottom surface of the box portion, to an open position where the butterfly door is rotated away from the bottom surface of the box portion to provide access to the items stored within the bottom section of the tool case.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Although, for convenience, the following description refers to specific components, such as bit sockets, it should be understood that the invention is equally applicable to a wide variety of tools and components.

Figure 1:
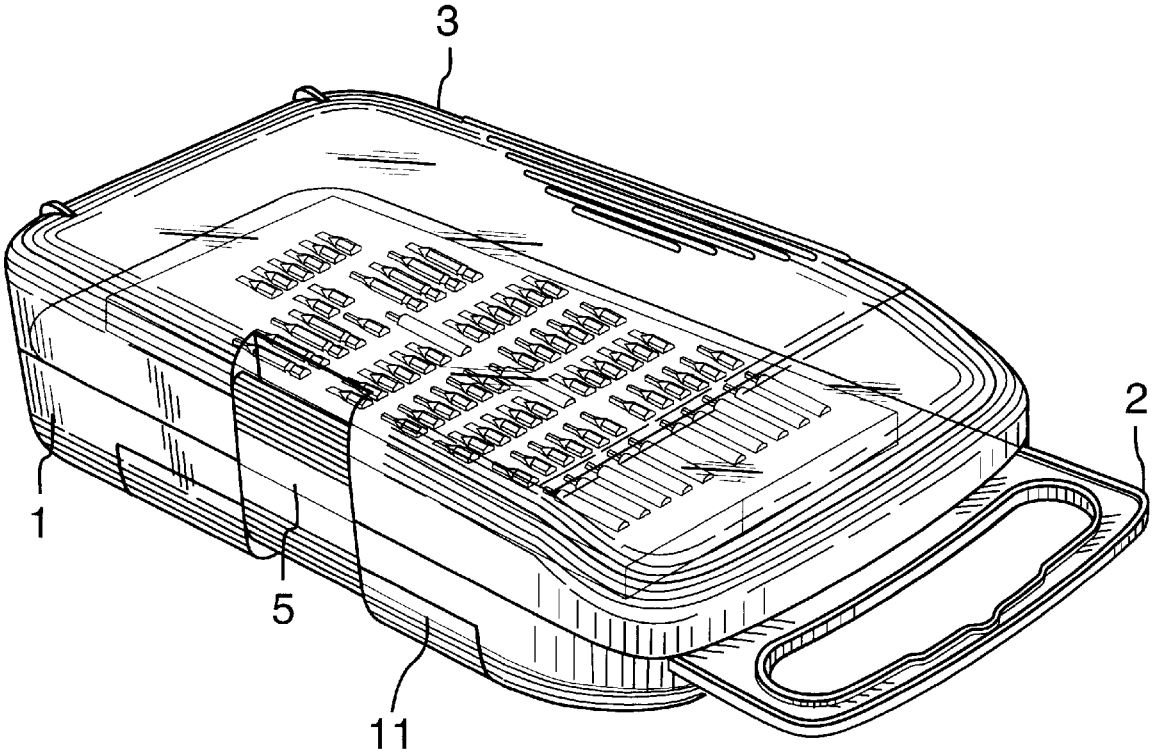
FIG. 1 is a perspective view looking down on the lid of the tool case.
Figure 2:
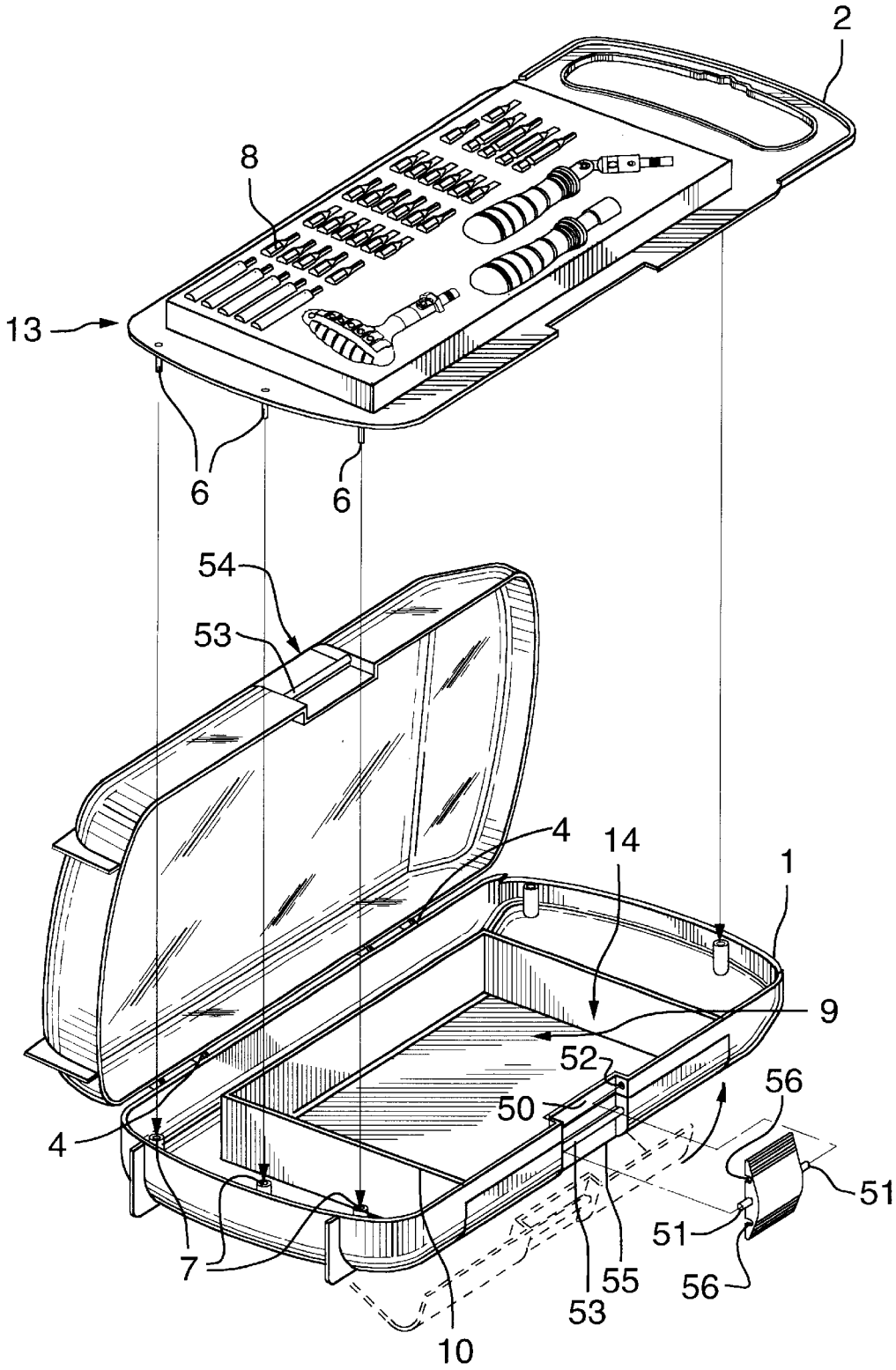
FIG. 2 is an exploded perspective view from the top of the tool cases showing the panel for tool and/or components.

Referring to the drawings, FIGS. 1 and 2 show the tool case which includes a main box portion 1 and a preferably transparent lid 3 hinged to the box portion, for example, by two lid hinges 4, and secured to the box portion by a clip 5 described in detail below. Preferably, the tool case is made entirely from plastic.

A plastic panel 13 with a molded handle 2 is secured to the box portion by, for example, inserting posts 6 protruding from the panel into corresponding sleeves 7 molded onto the box portion. Assorted shapes 8 are molded within the top face of the panel to securely retain corresponding tools with substantial depth, as well as components therefor such as screwdriver bits and sockets. Similar assorted shapes are molded within the bottom face of the panel to securely retain tool components of little depth, such as bits and sockets. The shapes in both faces of the panel are molded in such a way that the corresponding tools and components can be secured by snapping same into the corresponding shapes 8 in a conventional manner, so that the tools and components do not fall out of the face of the panel facing downward.

Figure 3:
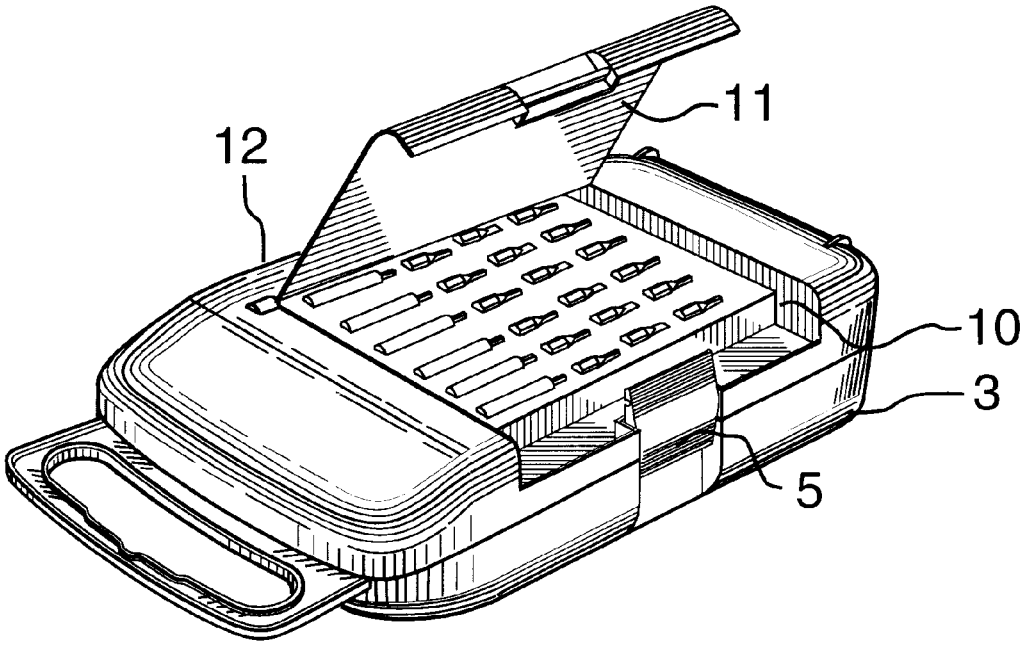
FIG. 3 is a perspective view looking down on the bottom portion of the tool case showing the storage space and a "butterfly" door in the open position.
Figure 4:
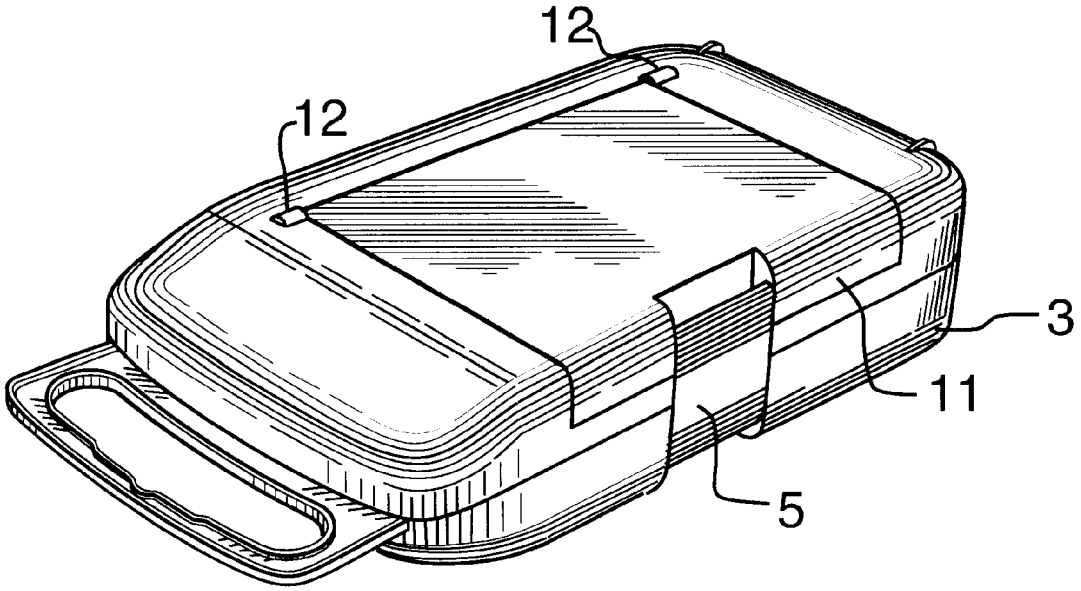
FIG. 4 is a perspective view looking down on the bottom portion of the tool case showing the butterfly door in the closed position.

FIGS. 2–4 show the preferred embodiment of the invention where a rectangular opening 9 is defined within the bottom surface of the box portion 1 to provide access the bottom face of the panel 13. Integrally molded interior walls 10 project upwardly from the edges of the opening to define a storage space 14. The bottom face of the panel is accessed via a "butterfly" door 11, which is pivotably connected to the bottom surface of the box portion by, for example, two butterfly door hinges 12. As best shown in FIG. 4, in the closed position, the outside surface of the butterfly door is flush with the bottom surface of the box portion and is secured to the box portion with a clip 5 which also secures the lid 3.

Figure 5:
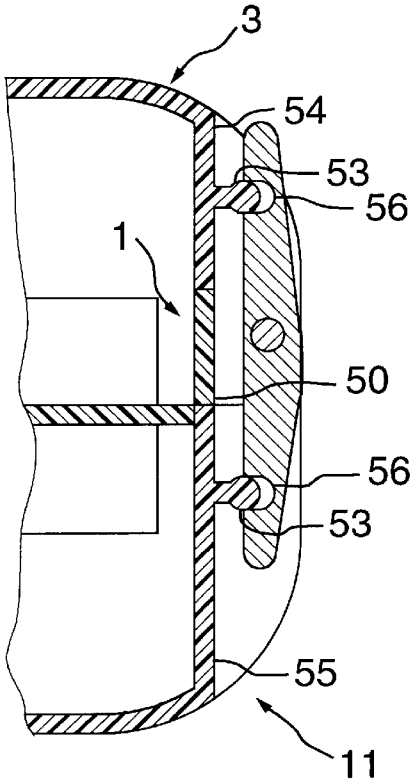
FIG. 5 is a cross-sectional view of the clip according to the preferred embodiment of the invention.

As best shown in FIGS. 2 and 5, the clip is pivotably mounted within a first depression 50 in the front of the box portion by pins 51 which project outwardly from the clip and are snapped into corresponding holes 52 located in the sides of the first depression. In the closed position, the lid 3 and the butterfly door 11 are secured to the clip by cylindrical male locking means 53 projecting outward from a corresponding second depression 54 defined in the front face of the lid and from a corresponding third depression 55 defined in the front face of the butterfly door. The cylindrical male locking means are snapped into co-operating female locking means 56 located on the top of the clip adjacent to the lid and the bottom of the clip adjacent to the butterfly door. The female locking means are recessed sufficiently to, not only accommodate the male locking means, but to also allow the clip to pivot sufficiently in the clockwise and counterclockwise directions to release the butterfly door 11 and the lid 3, respectively.

Accordingly, to release the lid 3, the user would push on the section of the clip 5 adjacent to the butterfly door 11, causing the clip to pivot away from the lid, releasing the adjacent male locking means 53 from the female locking means 56 and allowing the lid to be rotated to the open position. Conversely, to release the butterfly door, the user would push on the section of the clip adjacent to the lid, causing the clip to pivot away from the butterfly door releasing the adjacent male locking means from the female locking means and allowing the butterfly door to be rotated to the open position.

Figure 5A:
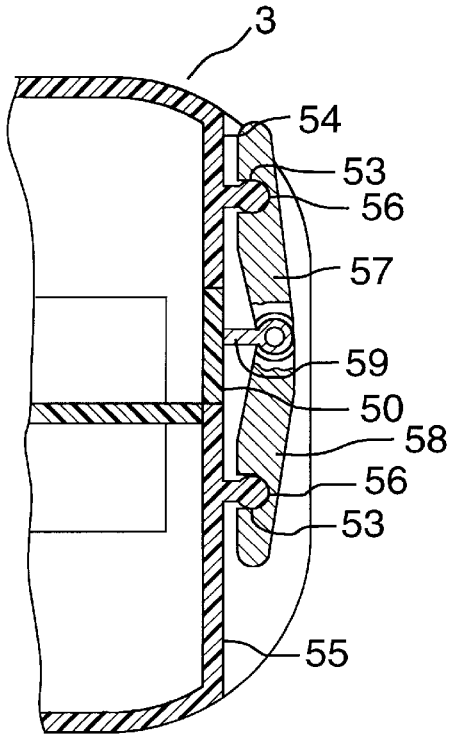
FIG. 5A is a cross-sectional view of the clip according to an alternative embodiment of the invention.
Figure 6:
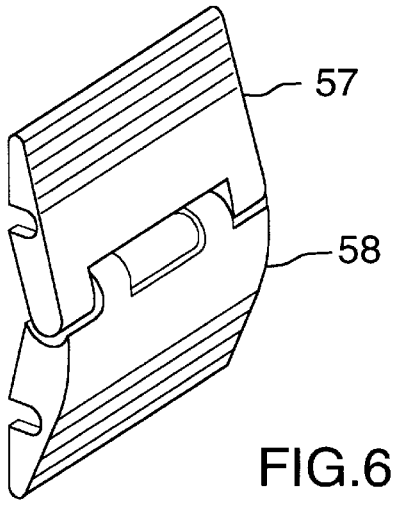
FIG. 6 is a perspective view of the clip according to the alternative embodiment of the invention.

Clearly, alternative means for securing the butterfly door to the box portion will be apparent to those skilled in the art, and are within the scope of this invention. For example FIGS. 5A and 6 show an alternative embodiment of the invention where the clip is comprised of an upper portion 57 to secure the lid, and a lower portion 58 to secure the butterfly door. The two portions are pivotably connected to a hinge member 59 which projects outwardly from the first depression 50 in the box portion 1. Female locking means 56 are defined within the upper portion and the lower portion, which tightly snap onto corresponding cylindrical male locking means 53 projecting outwardly from the second depression 54 and the third depression 55. To open the lid, the user simply pulls on the distal end of the upper portion of the clip to unsnap same, and simply snaps the upper portion back to secure the lid 3 in the closed position. The user would repeat the same process with the lower portion of the clip to open and close the butterfly door 11.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, the rectangular opening 9 and the butterfly door 11 can extend over the entire surface the bottom surface of the box portion, or alternatively, it could occupy only a section of the bottom surface of the box portion. It could also be combined with other storage assemblies.

Figure 7:
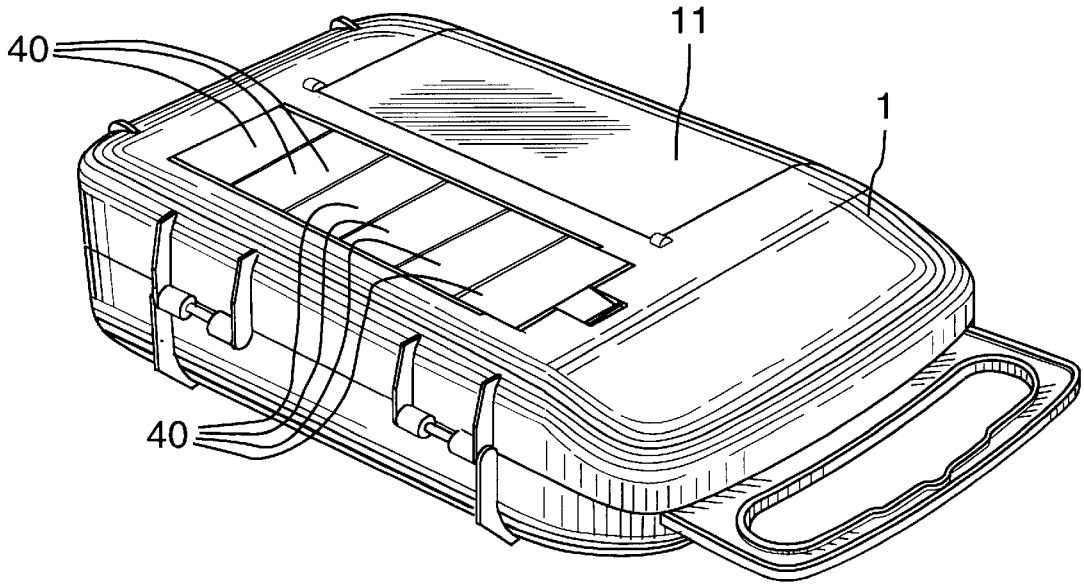
FIG. 7 is a perspective view of an alternative embodiment of the invention showing the butterfly door in combination with a "drop-bin" assembly.
Figure 8:
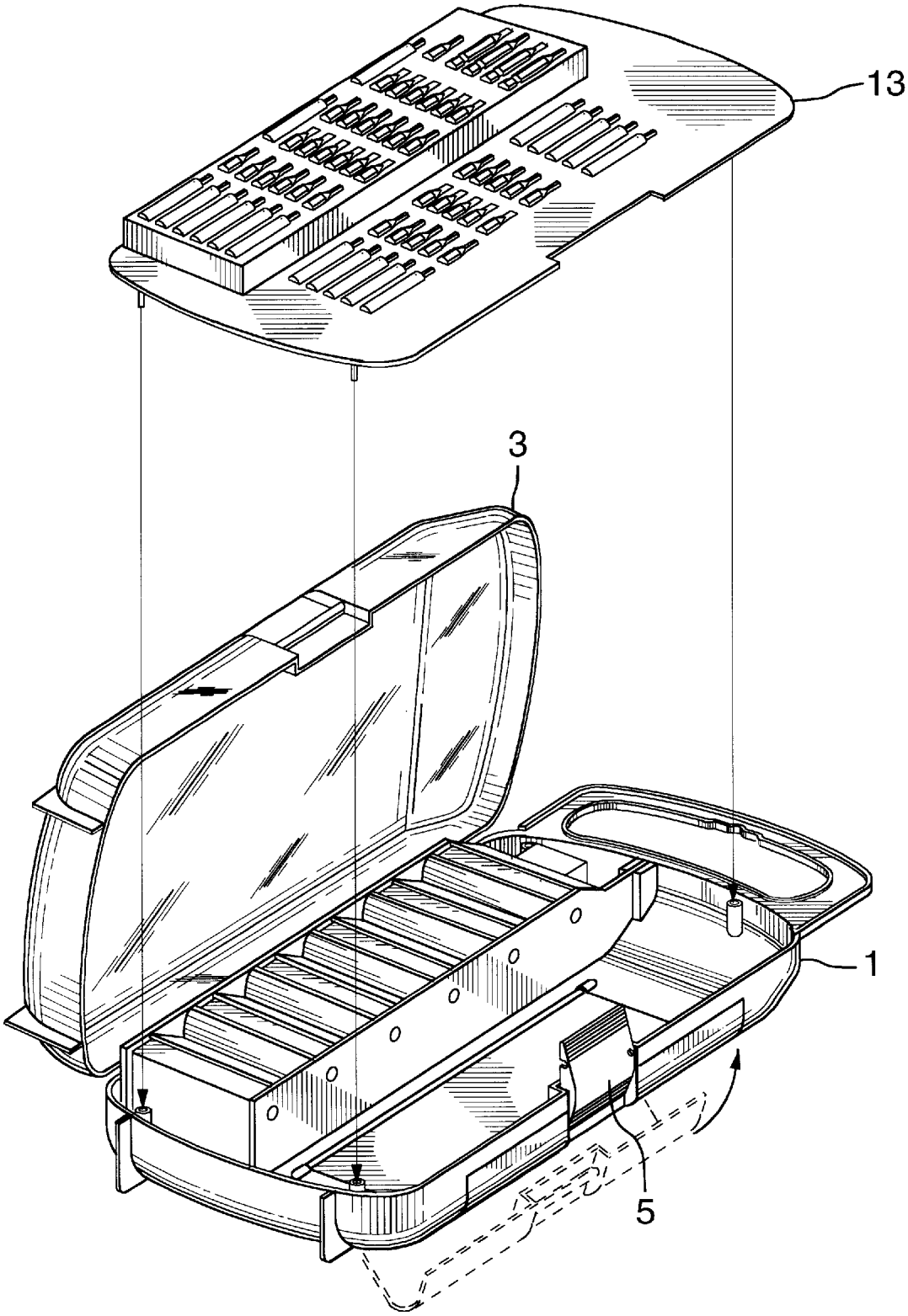
FIG. 8 is an exploded perspective view of the butterfly door in combination with the drop-bin assembly showing the panel for tools and/or components.
Figure 9:
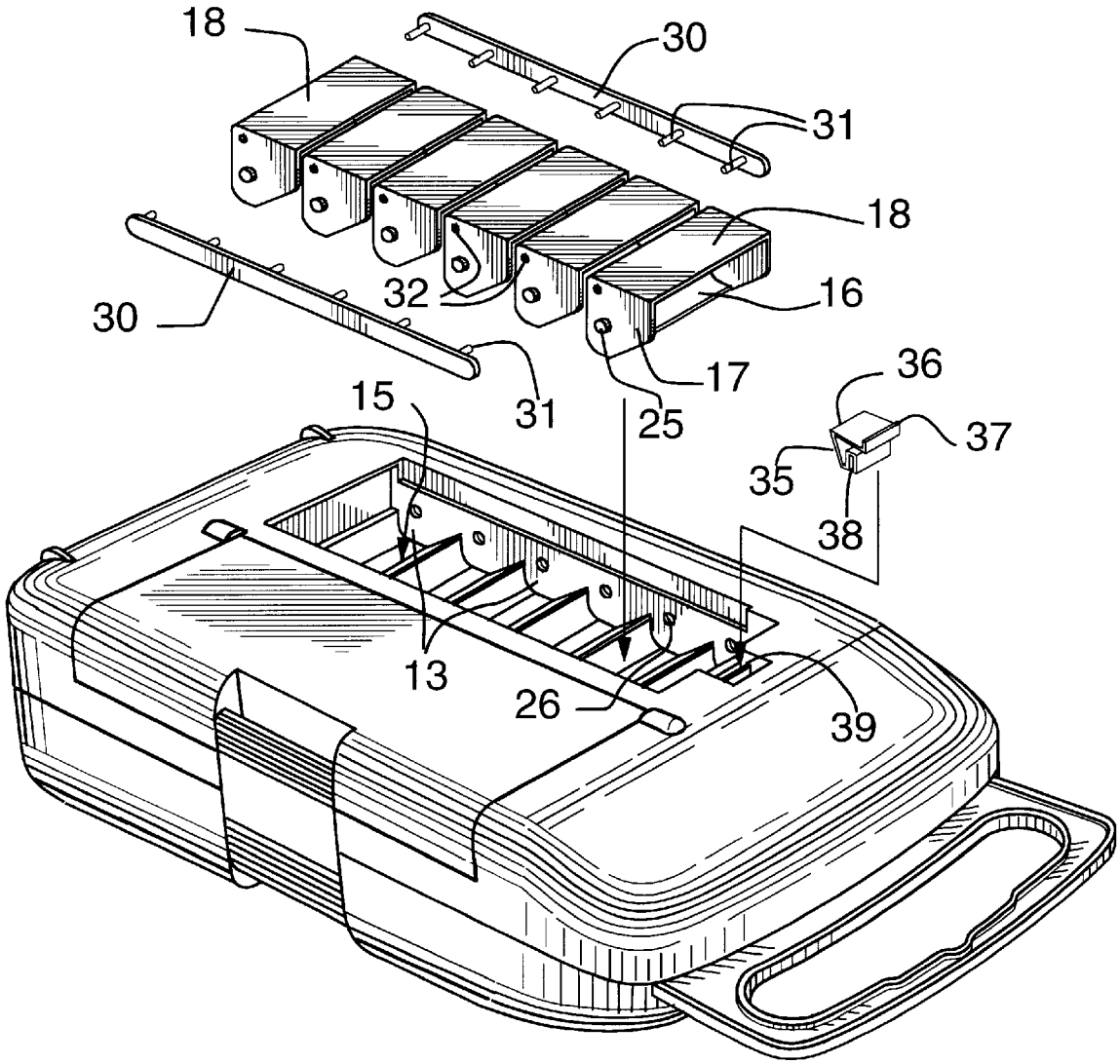
FIG. 9 is an exploded perspective view of the drop-bin assembly.

FIG. 7 shows one such alternative embodiment where the butterfly door assembly is combined with, for example, six storage containers 40. As best seen in FIGS. 8 and 9, a recess 15 is defined within the bottom surface of the box portion to accommodate the storage containers, such that a portion of the panel 13 must be raised accordingly to accommodate the recess and no shapes 8 are defined within the bottom surface of that portion of the panel. This raised section is adapted to hold components with little depth, such as screwdriver bits. The components are secured within the panel, as described above.

FIG. 9 shows the storage containers which have two identical parallel five-sided walls 17 which are joined by three generally rectangular faces 18 to form the container. The two remaining faces are open to provide access to the storage container. The storage containers are preferably molded from clear plastic to permit the user to examine the contents without opening the containers.

In the closed position, the faces of the storage containers form a single plane flush with the bottom surface of the box portion so that the bottom of the tool case can rest flat on a work surface when the user has opened the lid to access the tools in the panels.

Each storage container is pivotably connected to the sides of the recess 15 by cylindrical projections 25 which extend outwardly at a right angle from each wall of each storage container, and mate with corresponding recessed female connection means 26 defined within the sides of the recess. The recessed female connection means locate equidistantly along the length of the sides of the recess to accommodate a row of storage containers placed adjacent to each other. Alternative methods of pivotally connecting the storage containers to the box portion will be apparent to those skilled in the art and are within the scope of the invention.

Two gang bars 30 are located in the space between the walls 17 of the storage containers 40 and the corresponding sides of the recess 15. The gang bars are connected to the storage containers by molded plastic members 31 spaced along the length of the gang bars and projecting outwardly therefrom, which plastic members penetrate corresponding openings 32 in the side walls of each storage container. The gang bars restrict the movement of the storage containers so that they can only be pivoted in unison. It will be understood by those skilled in the art that only one gang bar may be employed for this purpose and such a variation would be within the scope of this invention.

The storage containers are prevented from freely rotating by a plastic clasp 35 molded from one piece of plastic, attached to the box portion and preferably located adjacent to the storage container closest to the handle. A section of the clasp is molded into an aperture 38, which is snapped by conventional means onto a cooperating plastic arm 39 extending upwardly from the box portion 1 to secure the clasp thereto. The clasp terminates in a ridge 36 extending over the face of the adjacent storage container which is flush with the bottom of the tool case to secure the storage container in a closed position. A catch 37 is molded to the opposite end of the clasp so that the user can easily grasp the clasp and pull the ridge back away from the adjacent container, thereby freeing the containers to pivot The user can then freely pivot the storage container adjacent to the clasp into an open position, and when he/she does so, he/she also moves the gang bar connected thereto, which gang bar then imparts the motion to all the other containers causing them to move to an open position in unison. To pivot the containers back into the closed position, the user again grasps the catch and pulls on the clasp until the ridge is pulled back sufficiently to permit the storage containers to be returned to the closed position where they are flush with the bottom surface of the tool case. The user then releases the catch, causing the ridge to extend over the adjacent storage container, thereby securing the containers in the closed position. It should be noted, however, that other suitable means of securing the storage containers to the box portion may be used and such means would be within the scope of the invention.

Figure 10:
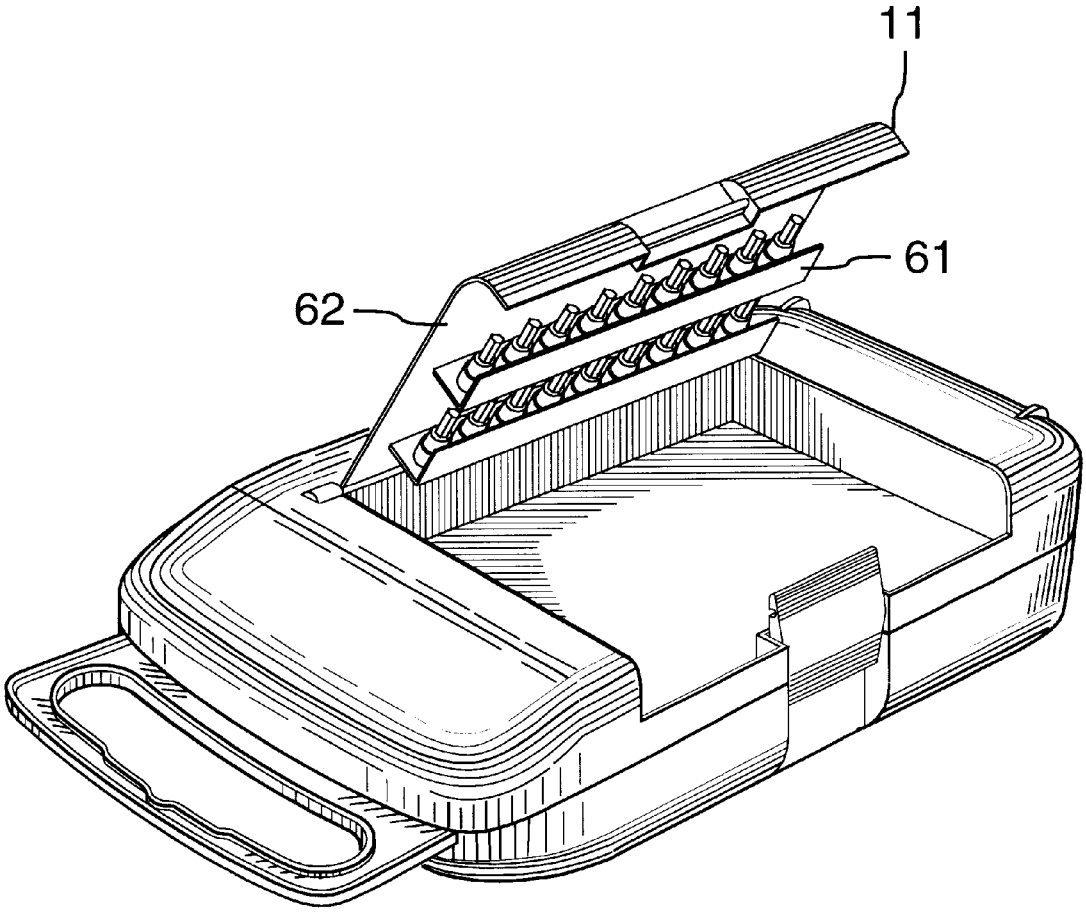
FIG. 10 is a perspective view of an alternative embodiment of the invention showing bit sockets mounted on rails integrally molded to the butterfly door.
Figure 11:
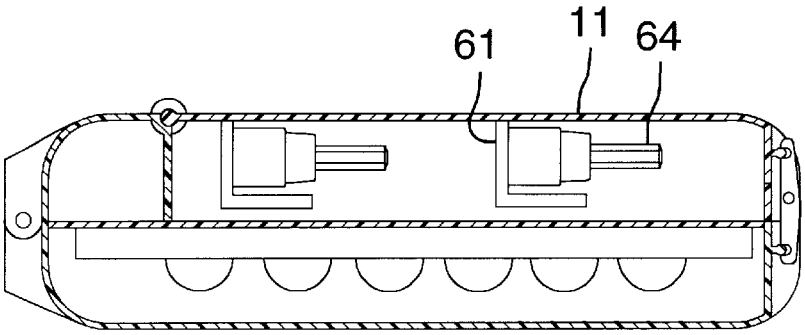
FIG. 11 is a cross-sectional view of bit sockets mounted on rails integrally molded to the butterfly door in the closed position.
Figure 12A:
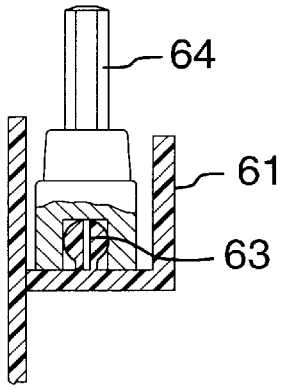
FIG. 12A is a cross-sectional view of a bit socket mounted on an integrally molded rail.
Figure 12:
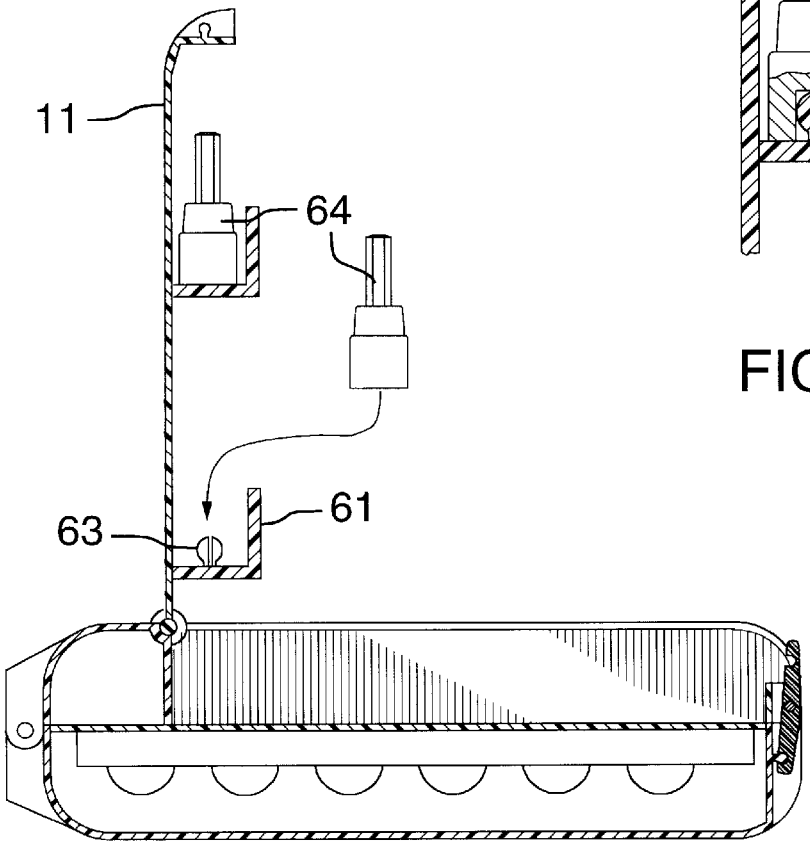
FIG. 12 is a cross-sectional view of bit sockets mounted on rails integrally molded to the butterfly door in the open position.

FIGS. 10–12 show an alternative embodiment of the invention, where two L-shaped plastic rails 61 are integrally molded on the underside 62 of the butterfly door 11. It will be clear to those skilled in the art that any number of rails may be molded to the butterfly door, and such variations are within the scope of this invention. A number of molded retaining members 63 configured to secure bit or drive sockets 64 project upwardly from the rails. The bit sockets are secured within the rails by snapping same to the retaining members.

Figure 13:
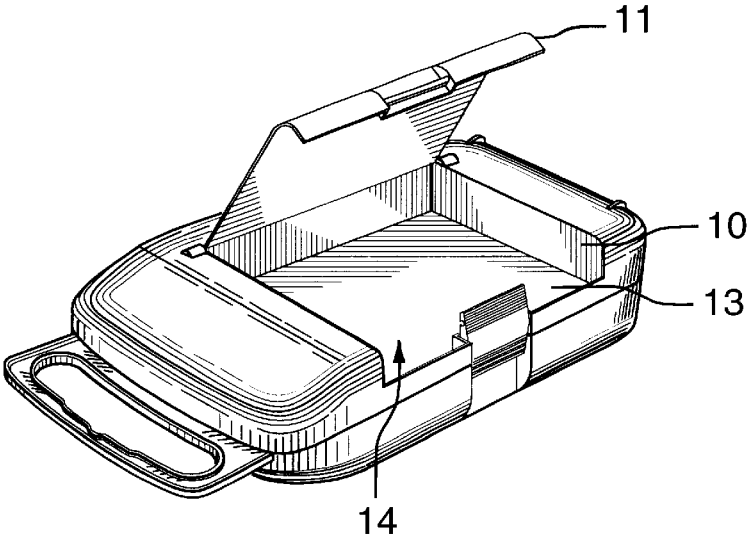
FIG. 13 is a perspective view of an alternative embodiment of the invention showing a storage space.

FIG. 13 shows another alternative embodiment of the invention where the underside of the panel 13 is flat and flush with the interior walls 10 to define a storage space 14 accessed via the butterfly door 11.

Figure 14:
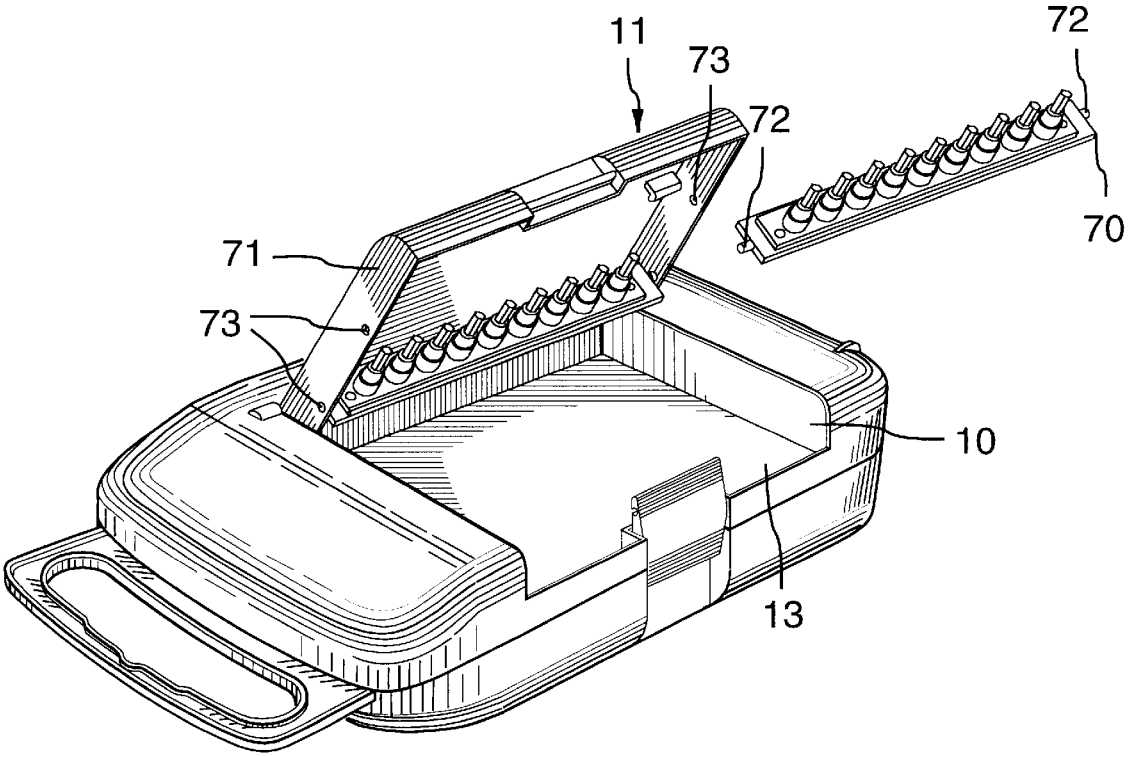
FIG. 14 is an exploded perspective view of an alternative embodiment of the invention showing rails pivotably connected to the butterfly door in the open position.
Figure 15:
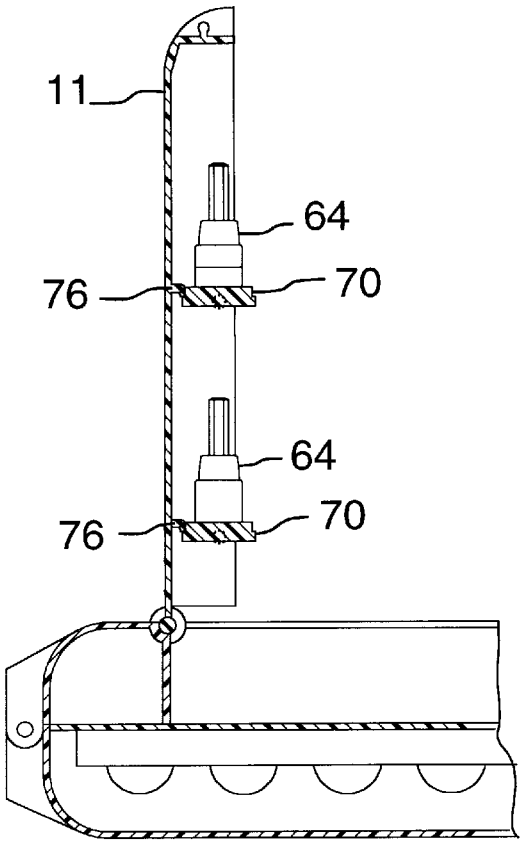
FIG. 15 is a cross-sectional view of bit sockets on rails pivotably connected to the butterfly door in the open position.
Figure 16:
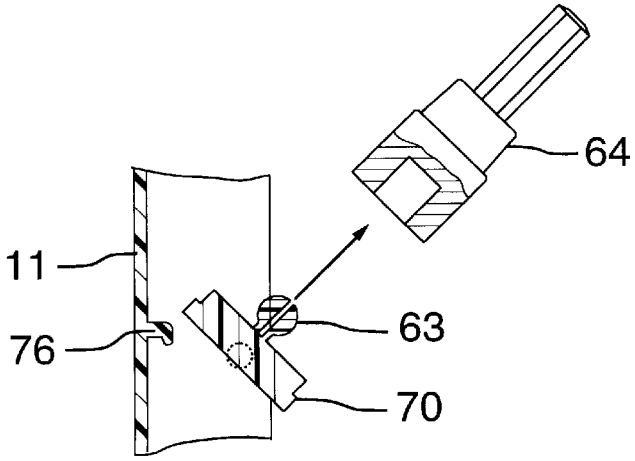
FIG. 16 is an exploded view showing the removal of a bit socket from a rail pivotably connected to the butterfly door.
Figure 17:
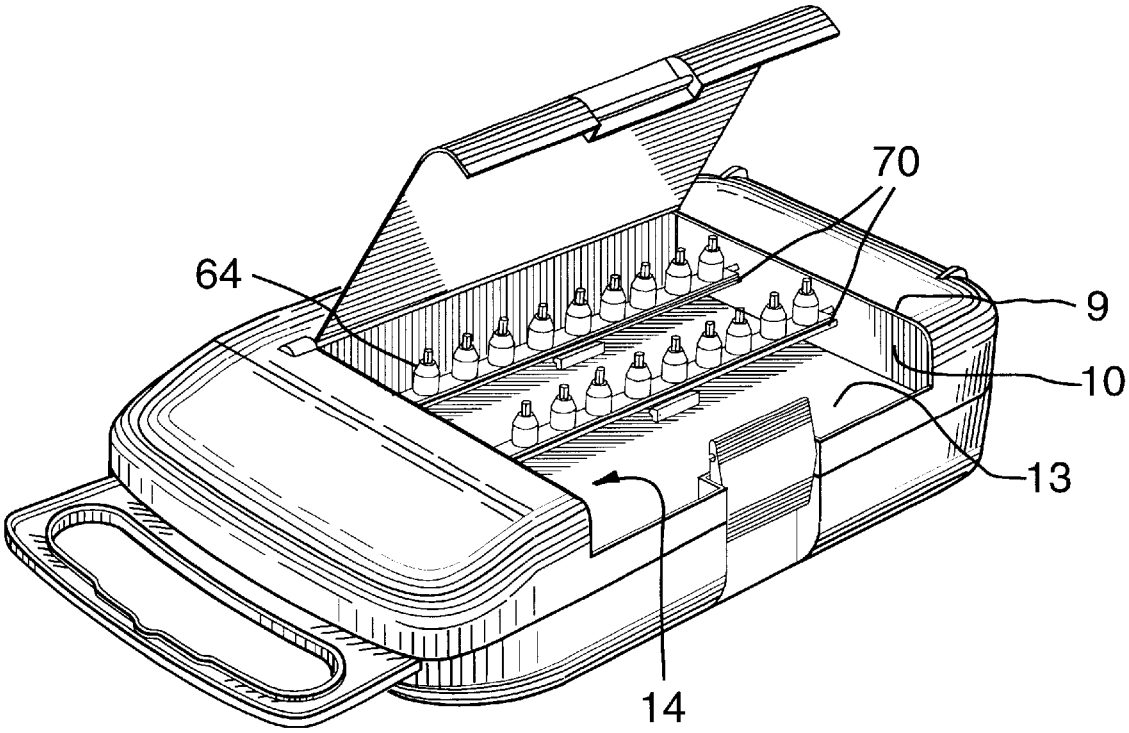
FIG. 17 is a perspective view of an alternative embodiment of the invention showing rails pivotably mounted within the storage space.
Figure 18:
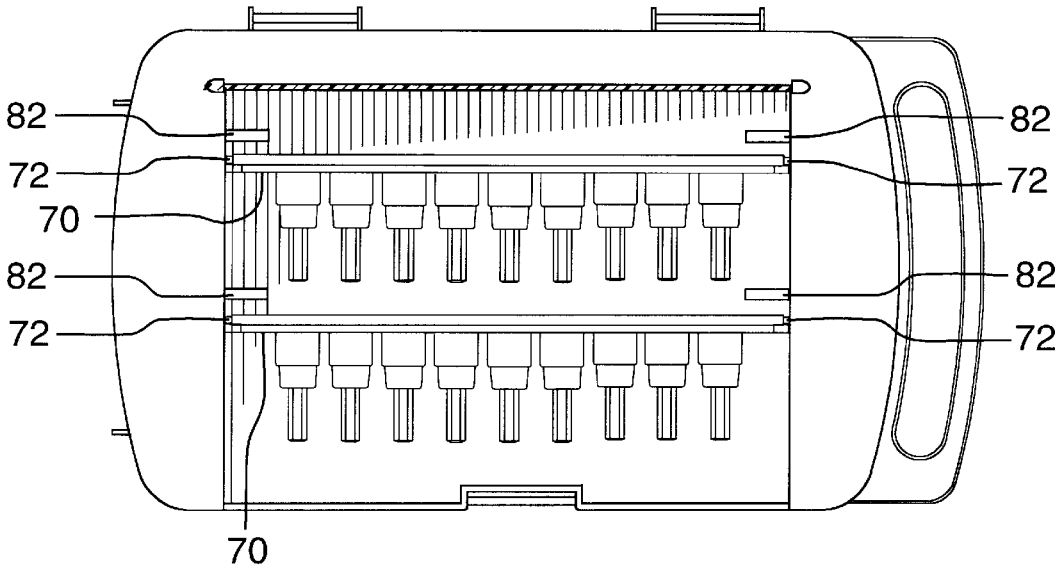
FIG. 18 is a bottom view of the tool case showing the rails pivotably mounted within the storage space in the stored position.
Figure 19:
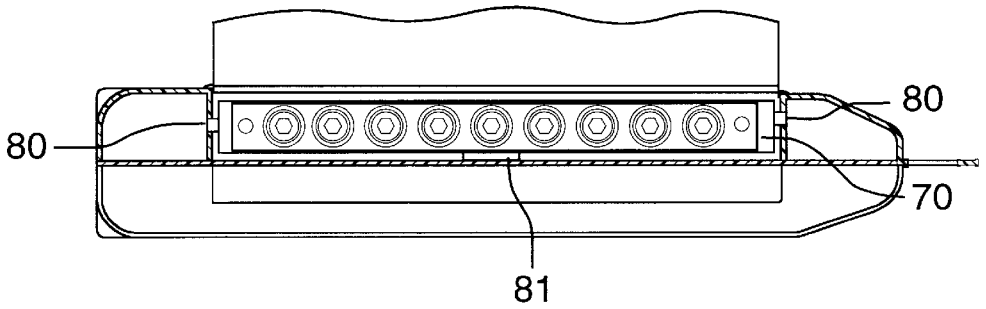
FIG. 19 is a cross-sectional view across the length of the tool case showing the rails pivotably mounted within the storage space in the stored position.
Figure 20:
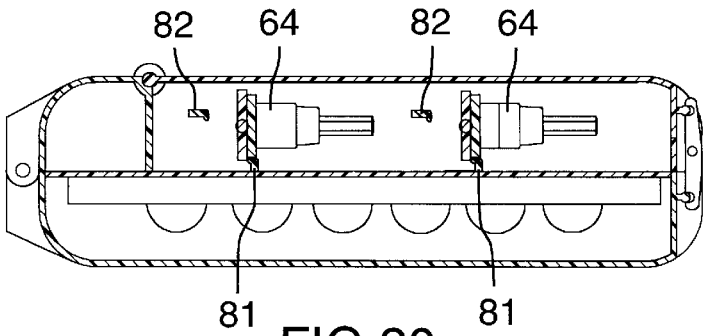
FIG. 20 is a cross-sectional view across the width of the tool case showing the rails pivotably mounted within the storage space in the stored position.
Figure 21:
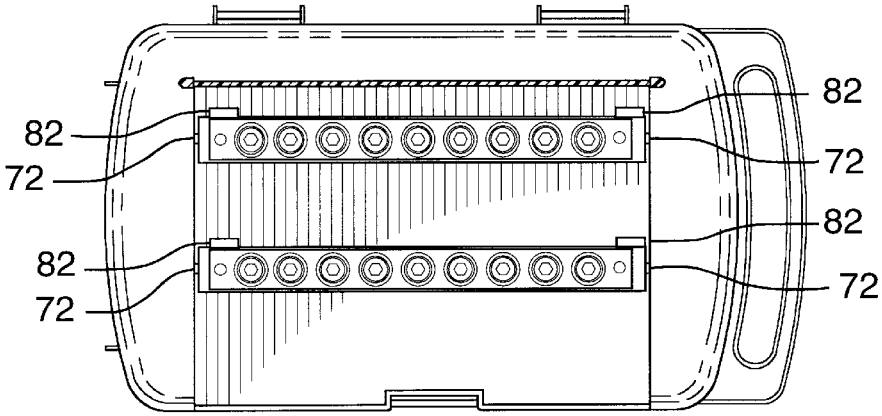
FIG. 21 is a bottom view of the tool case showing the rails pivotably mounted within the storage space in the rotated position.
Figure 22:
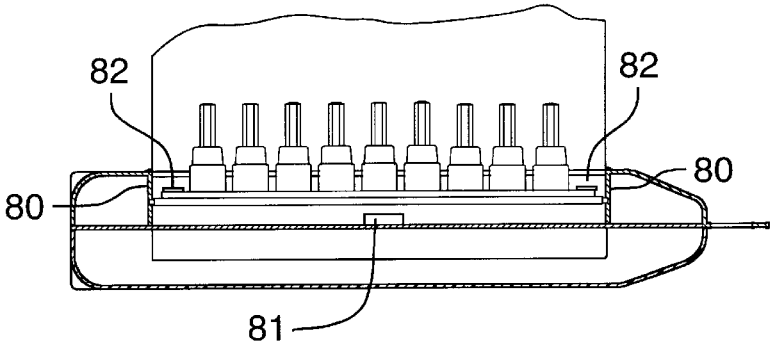
FIG. 22 is a cross-sectional view across the length of the tool case showing the rails pivotably mounted within the storage space in the rotated position.

FIGS. 14–16 show an alternative embodiment where two generally flat rails 70 are rotatably connected to integrally molded sides 71 of the butterfly door 11 via molded rail pins 72 projecting outwardly from each end of each rail, which locate within corresponding door holes 73 in the sides of the butterfly door. A number of molded retaining members 63 configured to store bit sockets 64 project upwardly from the rails. The bit sockets are secured to the rails by snapping same to the retaining members. The rails are configured to rotate clockwise from a first position perpendicular to the butterfly door such that the stored bit sockets are aligned with the butterfly door to a second position parallel to the butterfly door such that the bit sockets face away from the butterfly door and are easy to remove from the rail. The rails are secured in the first position by two integrally molded first catches 76 projecting outwardly from the underside of the butterfly door over the each rail. It will be understood by those skilled in the art that any number of rails could be mounted within the butterfly door, and such obvious variations are within the scope of this invention.

As best shown in FIG. 16, the user would pull out a socket by grasping it and rotating the rail 70 into the second position, thereby forcing it through the first catches 76. He/she would then pull the socket out of the corresponding retaining member 63 and rotate the rail back into the first position engaging the first catches. The same procedure is followed to replace the socket after use.

FIGS. 17–23 show an alternative embodiment of the invention where the underside of the panel 13 is flat and flush with the interior walls 10 to define a box-shaped storage space 14 in which two rails 70 are mounted. The rails are pivotably connected to opposite interior walls via rail pins 72 projecting outwardly from the rails which locate in corresponding wall holes 80. A number of molded retaining members 63 configured to store bit sockets 64 project upwardly from the rails. The bit sockets are secured to the rails by snapping same to the retaining members. It will be understood by those skilled in the art that any number of rails could be mounted within the butterfly door, and such obvious variations are within the scope of this invention.

The rails are configured to rotate approximately 90° counterclockwise from a first position where the bit sockets are stored parallel to the bottom face of the panel to a second position where the bit sockets are projecting outwardly toward the opening 9 of the storage space 14, thereby facilitating removal from the rail. The rails are secured in the first position by two integrally molded second catches 81 projecting outwardly from the underside of the panel door over the each rail. The rail is secured in the second position by two integrally molded third catches 82 projecting outwardly from opposite interior walls 10.

Figure 23:
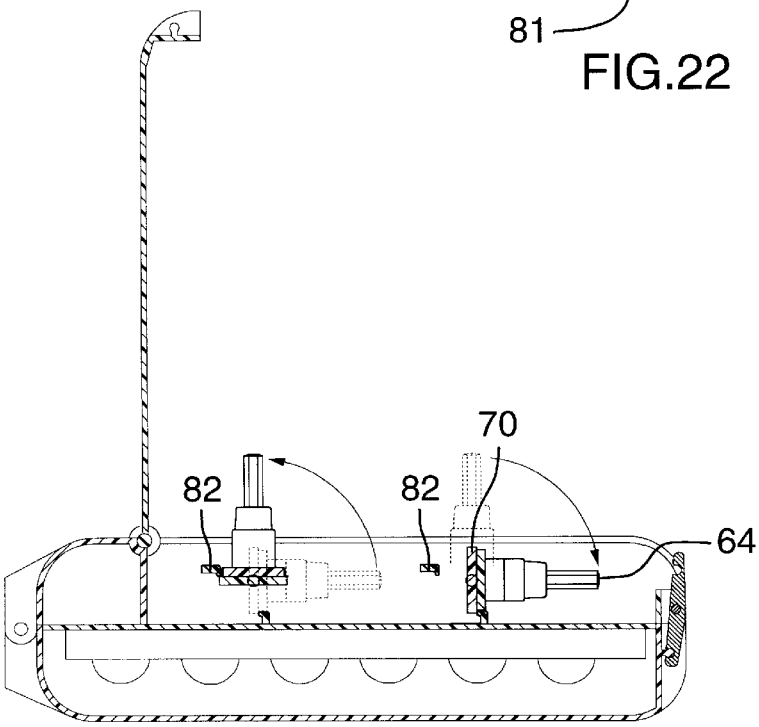
FIG. 23 is a cross-sectional view across the width of the tool case showing the rotation of the rails from and to the stored position.

As best shown in FIG. 23, the user would remove a socket by grasping it and rotating it counterclockwise, thereby forcing the rail 70 through the second catches and into the second position, securing the rail by snapping it into the third catches. When finished, the user would snap the bit socket 64 back onto the corresponding retaining member 63, and rotate the rail clockwise into the first position where it snaps back into the second catches.

What is claimed as the invention is:

1. A tool case comprising:

a box portion having a bottom surface;

a panel across an upper area of said box portion, said panel having means for holding items on an upper surface thereof;

a lid pivotally connected to said box portion, pivotable between an open position where said means for holding items are accessible, and a closed position where said means for holding items are covered by said lid;

at least one auxiliary storage area defined between said bottom surface of said box portion and an underside of said panel, at least one opening in said bottom surface of said box portion providing access to a said auxiliary storage area;

at least one door pivotally covering a surface of said bottom portion of said box portion, pivotally connected to said box portion, pivotable between an open position where a said auxiliary storage area is accessible and a closed position where that said auxiliary storage area is covered by said door, said door extending to one edge of said tool case for engagement by a latch means; and a single said latch means, arranged to releasably secure both said lid and said door to said box portion.

2. A tool case as in claim 1, wherein said panel is a separate piece from said box portion.

3. A tool case as in claim 1, wherein said latch means for releasably securing said lid and said door comprises a single latch positionable to engage catches on both said lid and said door.

4. A tool case as in claim 3, wherein said latch is pivotable between a position where said door is released into an open position while said lid is retained in said closed position, a position where said lid is released into an open position while said door is retained in the closed position, and a central position where said lid and said door are both latched.

5. A tool case as recited in claim 1, wherein said door covers a substantial portion of said bottom surface of said box portion, and wraps around onto a side of said box portion for engagement by said latch means.

* * * * *